US011447286B2

(12) United States Patent
Sollie et al.

(10) Patent No.: US 11,447,286 B2
(45) **Date of Patent: *Sep. 20, 2022**

(54) BOX WITH FOLDABLE HANDLE

(71) Applicant: Pratt Corrugated Holdings, Inc., Brookhaven, GA (US)

(72) Inventors: Greg Sollie, Sharpsburg, GA (US); Jamie Waltermire, Peachtree City, GA (US); Shifeng Chen, Newport News, VA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/339,278

(22) Filed: Jun. 4, 2021

(65) Prior Publication Data

US 2021/0292042 A1 Sep. 23, 2021

Related U.S. Application Data

(63) Continuation of application No. 16/520,548, filed on Jul. 24, 2019, now Pat. No. 11,053,048.

(51) Int. Cl.
*B65D 5/46* (2006.01)
*B65D 5/20* (2006.01)
(Continued)

(52) U.S. Cl.
CPC ..... *B65D 5/46112* (2013.01); *B65D 5/2057* (2013.01); *B65D 5/241* (2013.01);
(Continued)

(58) Field of Classification Search
CPC .. B65D 5/2057; B65D 5/46096–46112; B65D 5/16128–46114;
(Continued)

(56) References Cited

U.S. PATENT DOCUMENTS 2,007,810 A 7/1935 Oman et al.
2,008,443 A 7/1935 Froehlig
(Continued)

FOREIGN PATENT DOCUMENTS

EP 0053568 6/1982
EP 0053568 A1 * 6/1982
(Continued)

OTHER PUBLICATIONS

Westerman, Frank E.; Notice of Allowance for U.S. Appl. No. 10/295,171, filed Nov. 15, 2002, dated Mar. 8, 2004, 4 pgs.
(Continued)

*Primary Examiner* — Nathan J Newhouse
*Assistant Examiner* — Phillip D Schmidt
(74) *Attorney, Agent, or Firm* — Taylor English Duma LLP

(57) ABSTRACT

A box can include a first side panel; a second side panel positioned perpendicular to the first side panel; a top panel joined to the first side panel; and a handle assembly, the handle assembly including a handle portion attached the top panel, the handle portion including a tab at a side end of the handle portion, and a locking panel attached to the second side panel, the locking panel defining a cut pattern, the cut pattern defining a space therewithin, the cut pattern defining a top edge and an inner flap, the top edge of the cut pattern being a fold line formed by folding the inner flap up above the top edge; and wherein the tab is received by the space.

20 Claims, 12 Drawing Sheets

(51) Int. Cl.
*B65D 5/36* (2006.01)
*B65D 5/42* (2006.01)
*B65D 5/24* (2006.01)

(52) U.S. Cl.
CPC ..... *B65D 5/3678* (2013.01); *B65D 5/4266* (2013.01); *B65D 2525/288* (2013.01)

(58) Field of Classification Search
CPC ..... B65D 5/4616–46176; B65D 5/10; B65D 5/2052; B65D 2525/288
USPC ..... 229/117.14, 117.15
See application file for complete search history.

(56) References Cited

U.S. PATENT DOCUMENTS

| | | | | |
|---|---|---|---|---|
| 2,147,503 | A | 2/1939 | Seifer et al. | |
| 2,151,472 | A | 3/1939 | Hubbard | |
| 2,269,013 | A | 1/1942 | Dorfman et al. | |
| 2,805,813 | A | 9/1957 | Rittmueller et al. | |
| 3,131,849 | A | 5/1964 | Paige | |
| 3,140,813 | A | 7/1964 | Hall et al. | |
| 3,193,176 | A | 7/1965 | Gullickson et al. | |
| 3,194,480 | A | 7/1965 | Maindron et al. | |
| 3,246,829 | A | 4/1966 | Sexton et al. | |
| 3,254,827 | A | 6/1966 | Chapman | |
| 3,465,948 | A | 9/1969 | Boyer | |
| 3,780,934 | A | 12/1973 | Gardner | |
| 4,119,265 | A | 10/1978 | Dlugopolski | |
| 4,171,763 | A | 10/1979 | Card | |
| 4,176,423 | A | 12/1979 | Wigemark | |
| 4,238,069 | A | 12/1980 | Morris, Jr. | |
| 4,328,923 | A | 5/1982 | Graser | |
| 4,403,728 | A * | 9/1983 | Koltz | B65D 5/46112 229/117.22 |
| 4,465,227 | A | 8/1984 | Hood et al. | |
| 4,678,079 | A | 7/1987 | Henning | |
| 4,687,130 | A | 8/1987 | Beeler | |
| 4,784,497 | A | 11/1988 | Dutton | |
| 5,018,663 | A | 5/1991 | Corso | |
| 5,020,337 | A | 6/1991 | Kreig | |
| 5,042,715 | A | 8/1991 | McNeil | |
| 5,050,766 | A | 9/1991 | Groh | |
| 5,062,527 | A | 11/1991 | Westerman | |
| 5,074,460 | A | 12/1991 | Hanekamp | |
| 5,094,359 | A | 3/1992 | Demars et al. | |
| 5,263,339 | A | 11/1993 | Evans | |
| 5,284,294 | A | 2/1994 | Floyd | |
| 5,303,863 | A | 4/1994 | Arasim | |
| 5,307,986 | A | 5/1994 | Schuster | |
| 5,392,984 | A | 2/1995 | Yocum | |
| 2,714,982 | A | 8/1995 | Strauss et al. | |
| 5,562,228 | A | 10/1996 | Ericson | |
| 5,853,121 | A | 12/1998 | Francisco | |
| 6,164,526 | A | 12/2000 | Dalvey | |
| 6,253,993 | B1 | 7/2001 | Lloyd et al. | |
| 6,736,309 | B1 | 5/2004 | Westerman et al. | |
| 6,837,420 | B2 | 1/2005 | Westerman et al. | |
| D674,690 | S | 1/2013 | Sill | |
| D675,520 | S | 2/2013 | Sill | |
| D688,939 | S | 9/2013 | Pearson et al. | |
| D693,676 | S | 11/2013 | Pearson et al. | |
| D693,677 | S | 11/2013 | Pearson et al. | |
| 8,627,999 | B2 * | 1/2014 | Wolf | B65D 5/029 229/117.15 |
| D720,989 | S | 1/2015 | Genender et al. | |
| D736,619 | S | 8/2015 | Parkes | |
| D742,738 | S | 11/2015 | Kim et al. | |
| D742,739 | S | 11/2015 | Kim et al. | |
| D760,446 | S | 6/2016 | Katers | |
| D773,294 | S | 12/2016 | Choi et al. | |
| D834,411 | S | 11/2018 | Vanderhulst et al. | |
| D845,760 | S | 4/2019 | Oliveira | |
| 11,053,048 | B2 | 7/2021 | Sollie et al. | |
| D936,476 | S | 11/2021 | Sollie et al. | |
| 2004/0031842 | A1 | 2/2004 | Westerman et al. | |
| 2011/0253774 | A1 | 10/2011 | Hill et al. | |
| 2016/0039559 | A1 * | 2/2016 | Williams | B65D 5/029 229/151 |
| 2016/0264340 | A1 | 9/2016 | Tu et al. | |
| 2019/0016500 | A1 | 1/2019 | Oliveira | |
| 2019/0185247 | A1 | 6/2019 | Sollie et al. | |
| 2020/0115131 | A1 | 4/2020 | Adams et al. | |
| 2021/0024247 | A1 | 1/2021 | Sollie et al. | |

FOREIGN PATENT DOCUMENTS

| | | | | |
|---|---|---|---|---|
| JP | H0538641 | | 2/1993 | |
| JP | H05338641 | | 12/1993 | |
| KR | 100408200 | | 12/2003 | |
| KR | 100408200 | B1 * | 12/2003 | |
| KR | 20110093662 | | 8/2011 | |
| KR | 20110093662 | A * | 8/2011 | |
| KR | 20140001976 | | 4/2014 | |
| KR | 20140001976 | U * | 4/2014 | |
| KR | 2018041020 | A * | 4/2018 | B65D 21/0209 |
| KR | 20180041020 | | 4/2018 | |
| WO | 8103478 | | 12/1981 | |
| WO | WO-8103478 | A1 * | 12/1981 | |

OTHER PUBLICATIONS

Westerman, Frank E.; Notice of Allowance for U.S. Appl. No. 10/642,536, filed Aug. 18, 2003, dated Oct. 4, 2004, 9 pgs.
Sollie, Greg; Corrected Notice of Allowance for U.S. Appl. No. 16/520,548, filed Jul. 24, 2019, dated Apr. 13, 2021, 2 pgs.
Sollie, Greg; Corrected Notice of Allowance for U.S. Appl. No. 16/520,548, filed Jul. 24, 2019, dated Jun. 8, 2021, 8 pgs.
Sollie, Greg; Non-Final Office Action for U.S. Appl. No. 16/520,548, filed Jul. 24, 2019, dated Nov. 13, 2020, 17 pgs.
Sollie, Greg; Notice of Allowance for U.S. Appl. No. 16/520,548, filed Jul. 24, 2019, dated Mar. 31, 2021, 5 pgs.
Large Brown Carrypack / Handled Food Box—Box of 125. Online, published date unknown. Retrieved on Feb. 12, 2021 from URL: https ://www .cater 4you .co. u k/acatalog/859-l arge-hand led-food-box. html.
Sollie, Greg; Applicant-Initiated Interview Summary for Design U.S. Appl. No. 29/699,253, filed Jul. 24, 2019, dated Apr. 21, 2021, 2 pgs.
Sollie, Greg; Applicant-Initiated Interview Summary for Design U.S. Appl. No. 29/699,253, filed Jul. 24, 2019, dated Jul. 6, 2021, 2 pgs.
Sollie, Greg; Non-Final Office Action for Design U.S. Appl. No. 29/699,253, filed Jul. 24, 2019, dated Feb. 17, 2021, 25 pgs.
Sollie, Greg; Notice of Allowance for U.S. Appl. No. 29/699,253, filed Jul. 24, 2019, dated Jun. 30, 2021, 5 pgs.
Sollie, Greg; Supplemental Notice of Allowance for Design U.S. Appl. No. 29/699,253, filed Jul. 24, 2019, dated Jul. 19, 2021, 6 pgs.
Westerman, Frank E.; Non-Final Office Action for U.S. Appl. No. 10/295,171, filed Nov. 15, 2002, dated Oct. 7, 2003, 7 pgs.
Sollie, Greg; Corrected Notice of Allowance for Design U.S. Appl. No. 29/699,253, filed Jul. 24, 2019, dated Oct. 25, 2021, 6 pgs.

* cited by examiner

BOX WITH FOLDABLE HANDLE

REFERENCE TO RELATED APPLICATION

This application is a continuation of U.S. application Ser. No. 16/520,548, filed Jul. 24, 2019, which is hereby specifically incorporated by reference herein in its entirety.

TECHNICAL FIELD

This disclosure relates to packaging. More specifically, this disclosure relates to a box with a foldable handle.

BACKGROUND

A box with a handle can be carried with one hand, facilitating its transport by retail customers. However, a handle on a box can interfere with stacking the boxes in a compact way.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a box comprising a first side panel; a second side panel positioned perpendicular to the first side panel; a top panel joined to the first side panel; and a handle assembly, the handle assembly comprising a handle portion attached the top panel, the handle portion comprising a tab at a side end of the handle portion, and a locking panel attached to the second side panel, the locking panel defining a cut pattern, the cut pattern defining a space therewithin, the cut pattern defining a top edge and an inner flap, the top edge of the cut pattern being a fold line formed by folding the inner flap up above the top edge; and wherein the tab is received by the space.

Also disclosed is a method of assembling a box, comprising obtaining a box blank, the box blank comprising a first side panel and a second side panel; a top panel joined to the first side panel; a handle portion attached to the top panel, the handle portion comprising a tab at a side end of the handle portion; a locking panel attached to the second side panel, the locking panel defining a cut pattern, the cut pattern defining a space therewithin; folding an inner flap defined by the cut pattern up above a fold line to form a top edge of the cut pattern; and inserting the tab of the handle portion into the space of the cut pattern of the locking panel.

Also disclosed is a blank for a box comprising a first side panel and a second side panel; a top panel joined to the first side panel; a handle portion attached to the top panel, the handle portion comprising a tab at a side end of the handle portion; and a locking panel attached to the second side panel, the locking panel defining a cut pattern, the cut pattern defining a space therewithin; and a top edge defined by a top fold line, the top fold line coupling a foldable flap to the locking panel, the foldable flap positioned within the space when the foldable flap is in an unfolded configuration, the foldable flap configured to fold upwards from the unfolded configuration to a folded configuration wherein the foldable flap is positioned above the top edge.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
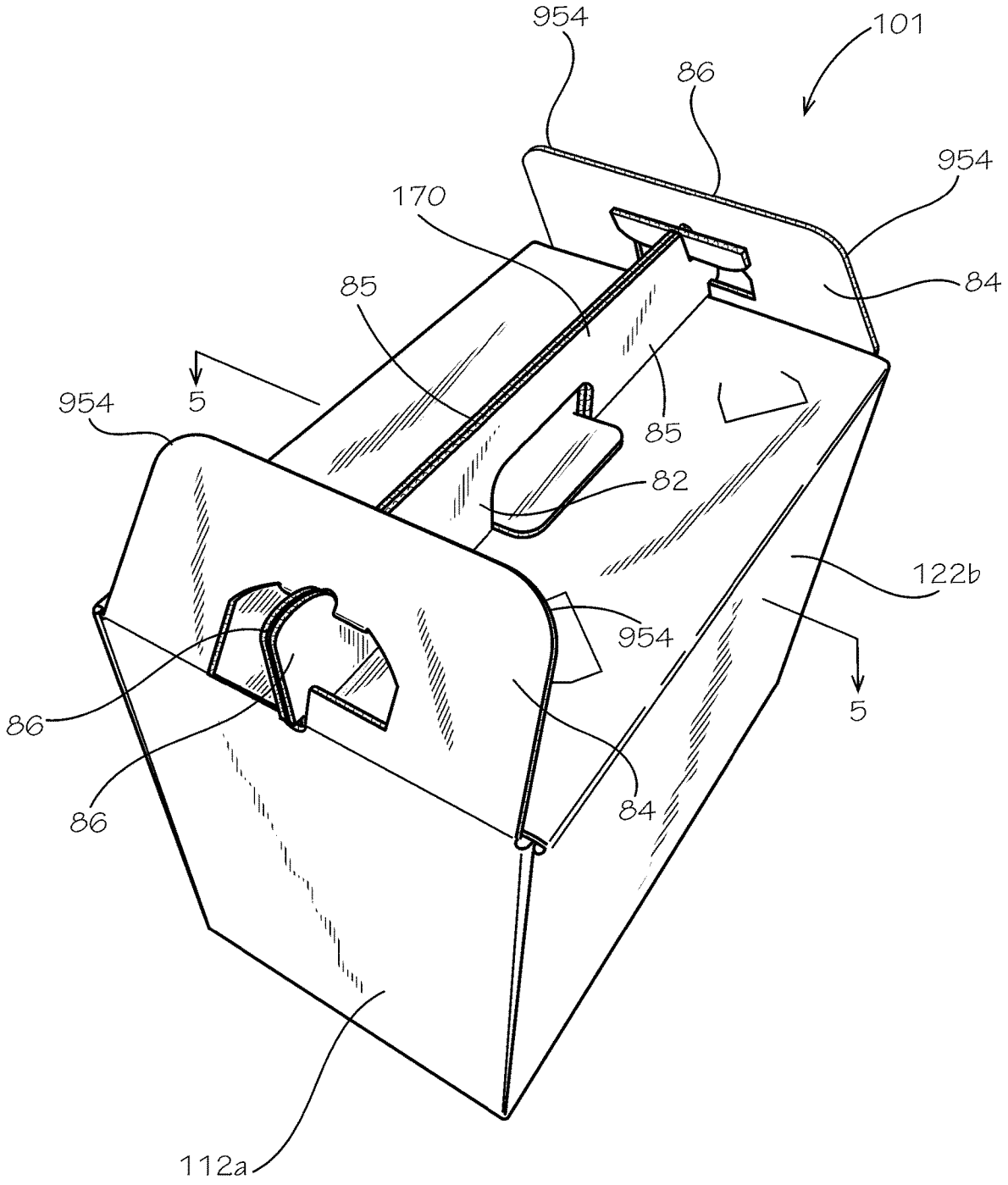
FIG. 1 is a perspective view of a box with a foldable handle in accordance with one aspect of the present disclosure, wherein the handle is in an upright configuration.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

The use of the directional terms herein, such as right, left, front, back, top, bottom, and the like can refer to the orientation shown and described in the corresponding figures, but these directional terms should not be considered limiting on the orientation or configuration required by the present disclosure. The use of ordinal terms herein, such as first, second, third, fourth, and the like can refer to elements associated with elements having matching ordinal numbers. For example, a first light bulb can be associated with a first light socket, a second light bulb can be associated with a second light socket, and so on. However, the use of matching ordinal numbers should not be considered limiting on the associations required by the present disclosure.

The box disclosed herein can comprise structure, such as side panels, shoulders, and bottom panels, similar to those described in the following application: U.S. patent application Ser. No. 15/845,545, filed Dec. 18, 2017, entitled "Modular Box Assembly." This application is hereby incorporated by reference in its entirety.

Disclosed is a box with a foldable handle and associated methods, systems, devices, and various apparatus. It would be understood by one of skill in the art that the box is described in but a few exemplary embodiments among many. No particular terminology or description should be considered limiting on the disclosure or the scope of any claims issuing therefrom. Terms used in the present disclosure can refer to identical terms in the incorporated references.

Figure 4:
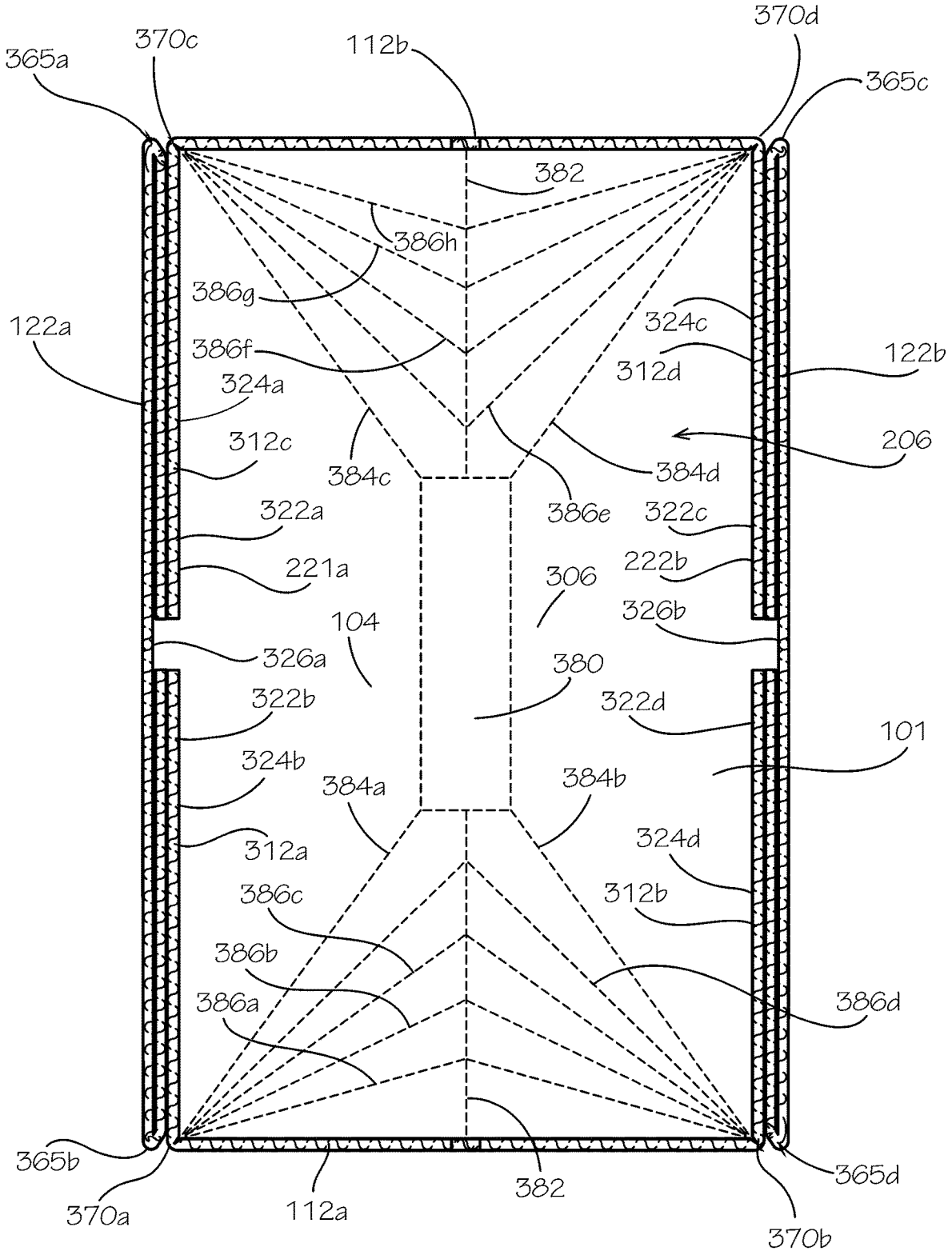
FIG. 4 is a cross-section of the box of FIG. 1, taken along line 5-5 in FIG. 1.

FIG. 1 is a perspective view of a box 101 with a foldable handle 170, with the handle 170 in an upright configuration. The handle 170 can be a part of a handle assembly 82, the handle assembly 82 further comprising locking panels 84. The locking panels 84 can comprise top corners 954, discussed further with respect to FIG. 9. The handle 170 can comprise two handle portions 85, each handle portion 85 comprising two side ends 86, each side end 86 secured by one of the locking panels 84 when the handle 170 is in the upright configuration. Line 5-5 defines a cross-sectional view, which is shown in FIG. 4. In one aspect, the box 101 can be adjustable about and between an expanded configuration (illustrated in FIG. 1) in which the box 101 has an expanded volume, and a collapsed configuration (illustrated in FIG. 5) in which the box 101 has a collapsed volume that is less than the expanded volume. The box 101 can comprise a rigid board material such as corrugated cardboard; however in other aspects, the box can comprise other suitable rigid board materials, such as wood, plastic, metal, or any other material.

The box 101 can comprise a first pair of opposing side panels 112*a,b* (112*b* not shown) and a second pair of opposing side panels 122*a,b* (122*a* not shown). That is, the box 101 can comprise a first side panel 112*a*, a second side panel 112*b* opposed to the first side panel, 112*a* a third side panel 122*a* positioned between the first side panel 112*a* and the second side panel 112*b*, and a fourth side panel 122*b* opposed to the third side panel 122*a* and positioned between the first and second side panels 112*a,b*. The side panels 112*a,b*, 122*a,b* can each be a rigid panel. In one aspect, the side panel 112*a* can be substantially parallel to the side panel 112*b*, and the side panel 122*a* can be substantially parallel to the side panel 122*b*. Each of the first pair of side panels 112*a,b* can be substantially perpendicular to the second pair of side panels 122*a,b*. In one aspect, the box 101 can define a rectangular or square cross-sectional shape, as shown in FIG. 4; however, in other aspects, the box 101 can define a different cross-sectional shape such as a circular, triangular, pentagonal, or hexagonal, shape or any other desired shape.

Figure 2:
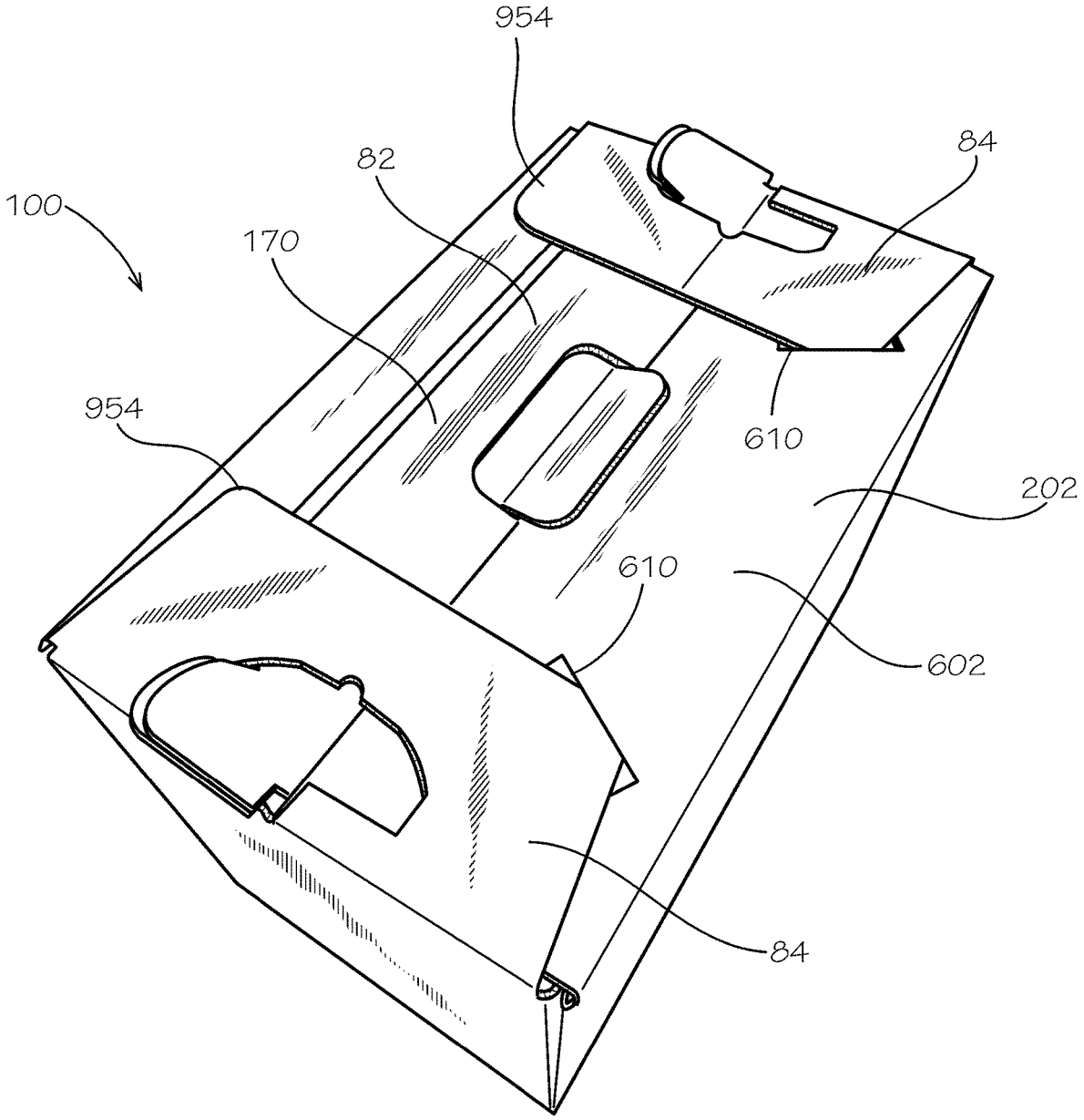
FIG. 2 is a perspective view of the box of FIG. 1, wherein the handle is in a folded-down configuration.

FIG. 2 is a perspective view of the box 101 of FIG. 1, wherein the handle 170 is in a folded-down configuration. The handle assembly 82 is discussed in further detail below. One of the top corners 954 of each locking panel 84 can be inserted into a securing cut 610 of a top panel 602, as discussed further with respect to FIG. 6 and FIG. 12. In the folded-down configuration, an upper surface 202 of the box 101 can be substantially planar, such that a plurality of the boxes 101 can be stacked on each other.

Figure 3:
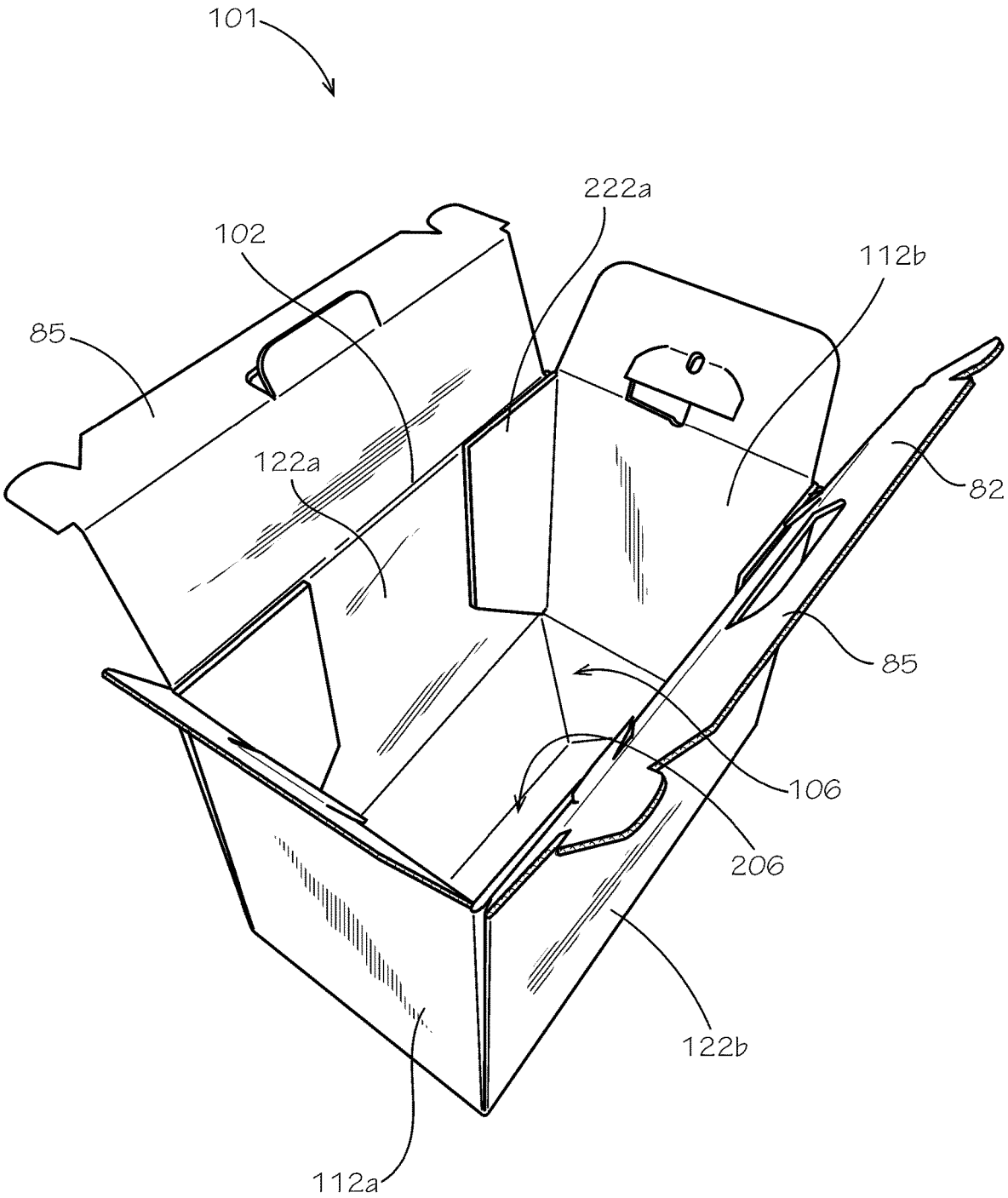
FIG. 3 is a perspective view of the box of FIG. 1, wherein a handle assembly is disassembled.

FIG. 3 is a perspective view of the box 101 of FIG. 1, wherein the handle assembly 82 is disassembled. The box 101 can define a box opening 106 at a top end 102 thereof. The first pair of opposing side panels 112*a,b* and the second pair of opposing side panels 122*a,b* of the box 101 can define a box cavity 206. A pair of shoulders 222*a,b* can extend inwards into the box cavity 206 from each of the side panels 122*a,b*, as represented by the shoulder 222*a* (shoulder 222*b* shown in FIG. 4).

FIG. 4 is a cross-section of the box 101 of FIG. 1 taken along line 5-5 shown in FIG. 1, with the handle 170 removed. In one aspect, each shoulder 222*a,b* can comprise two sub-shoulders 322. The shoulder 222*a* can comprise sub-shoulders 322*a,b*, and the shoulder 222*b* can comprise sub-shoulders 322*c,d*. The sub-shoulders 322*a-d* can be defined by a plurality of first wings 312*a-d* and a plurality of second wings 324*a-d*. The first wings 312*a,b* can be attached at opposite sides of the side panel 112*a*, and the first wings 312*c,d* can be attached at opposite sides of the side panel 112*b*. The second wings 324*a,b* can be attached at opposite sides of the side panel 122*a*, and the second wings 324*c,d* can be attached at opposite sides of the side panel 122*b*.

The second wing 324*a* can be folded inwards at a hinge 365*a* and positioned adjacent to an inner side surface 326*a* of the side panel 122*a*, and the first wing 312*c* can be folded at a hinge 370*c* and positioned adjacent to the second wing 324*a*. The second wing 324*a* and the first wing 312*c* can be secured in position, such as with an adhesive, to form the sub-shoulder 322*a*. The second wing 324*b* can be folded inwards at a hinge 365*b* and positioned adjacent to the inner side surface 326*a*, and the first wing 312*a* can be folded at a hinge 370*a* and positioned adjacent to the second wing 324*b*. The second wing 324*b* and the first wing 312*a* can be secured in position, such as with an adhesive, to form the sub-shoulder 322*b*.

To form the sub-shoulder 322*c* of shoulder 222*b*, the second wing 324*c* can be folded inward at a hinge 365*c* and positioned adjacent to an inner side surface 326*b* of the side panel 122*b*. The first wing 312*d* can be folded at a hinge 370*d* and positioned adjacent to the second wing 324*c*. The first wing 312*d* and the second wing 324*c* can be secured in position, such as with an adhesive, to form the sub-shoulder 322*c*. To form the sub-shoulder 322*d* of shoulder 222*b*, the second wing 324*d* can be folded inward at a hinge 365*d* and positioned adjacent to the inner side surface 326*b*. The first wing 312*b* can be folded at a hinge 370*b* and positioned adjacent to the second wing 324*d*. The first wing 312*b* and the second wing 324*d* can be secured in position, such as with an adhesive, to form the sub-shoulder 322*d*.

The formation of the sub-shoulders 322*a-d* can also secure each of the first pair of side panels 112*a,b* to each of the second pair of side panels 122*a,b*, thereby defining the square or rectangular horizontal cross-section of the box 101. In one aspect, the box 101 can further comprise a bottom panel 306. The bottom panel 306 can be a rigid panel. The bottom panel 306 can be disposed at the bottom end 104 of the box 101, and the bottom panel 306 can be attached to each of the side panels 112*a,b*, 122*a,b*. The bottom panel 306 can further define the box cavity 206.

In the present aspect, the bottom panel 306 can define a center subpanel 380 disposed substantially at a center of the bottom panel 306. The center subpanel 380 can be substantially rectangular in shape. In the collapsed configuration, the rectangular-shaped center subpanel 380 in one aspect can define a width that matches a thickness of the collapsed box, thereby relieving pressure from the fold lines of the bottom panel 306.

A center fold line 382 such as, for example, a scored crease, can extend between the center subpanel 380 and each side panel 112*a,b*, and the center fold line 382 can substantially bisect the bottom panel 306, with the exception of within the center subpanel 380. The center fold line 382 can also bisect each side panel 112*a,b*, as shown and further described with respect to FIG. 9. In one aspect, and with respect to FIG. 6, the center fold line 382 can comprise a double center fold line 382. That is, the center fold line can comprise at least a first center fold line 382*a* and a second center fold line 382*b* positioned adjacent to each other. In this aspect, the center fold line 382 can comprise two substantially parallel fold lines spaced a predetermined distance apart. In another aspect, the distance between the center fold lines 382*a,b* can be less than a width of the center subpanel 380.

In one aspect, four corner fold lines 384*a-d* can extend between the corners of the center subpanel 380 and the hinges 370*a-d*. For example, a first corner fold line 384*a* can extend from a first hinge 370*a* to the center subpanel 380, a second corner fold line 384*b* can extend from a second hinge 370*b* to the center subpanel 380, a third corner fold line 384*c* can extend from a third hinge 370*c* to the center subpanel 380 and a fourth corner fold line 384*d* can extend from a fourth hinge 370*d* to the center subpanel 380.

A plurality of V-shaped fold lines 386*a-h* can extend between the hinges 370*a-d* and the center fold line 382. In one aspect, the V-shaped fold lines 386*a-d* can each extend from the first hinge 370*a* to the center fold line 382 and then to the second hinge 370*b*. The V-shaped fold lines 386*a-d* can be defined between the corner fold lines 384*a* and 384*b*. The V-shaped fold lines 386*e-h* can each extend from the third hinge 370*c* to the center fold line 382 and then to the fourth hinge 370*d*. The V-shaped fold lines 386*e-h* can be defined between the corner fold lines 384*c* and 384*d*. In use, the center subpanel 380, the center fold line 382, the corner fold lines 384*a-d*, and the V-shaped fold lines 386*a-h* can cooperate to collapse the box 101. Optionally, the center subpanel 380, the center fold line 382, the corner fold lines 384*a-d*, and the V-shaped fold lines 386*a-h* can provide the bottom panel with a truncated pyramidal shape when collapsed, as further discussed below with respect to FIG. 5.

Figure 5:
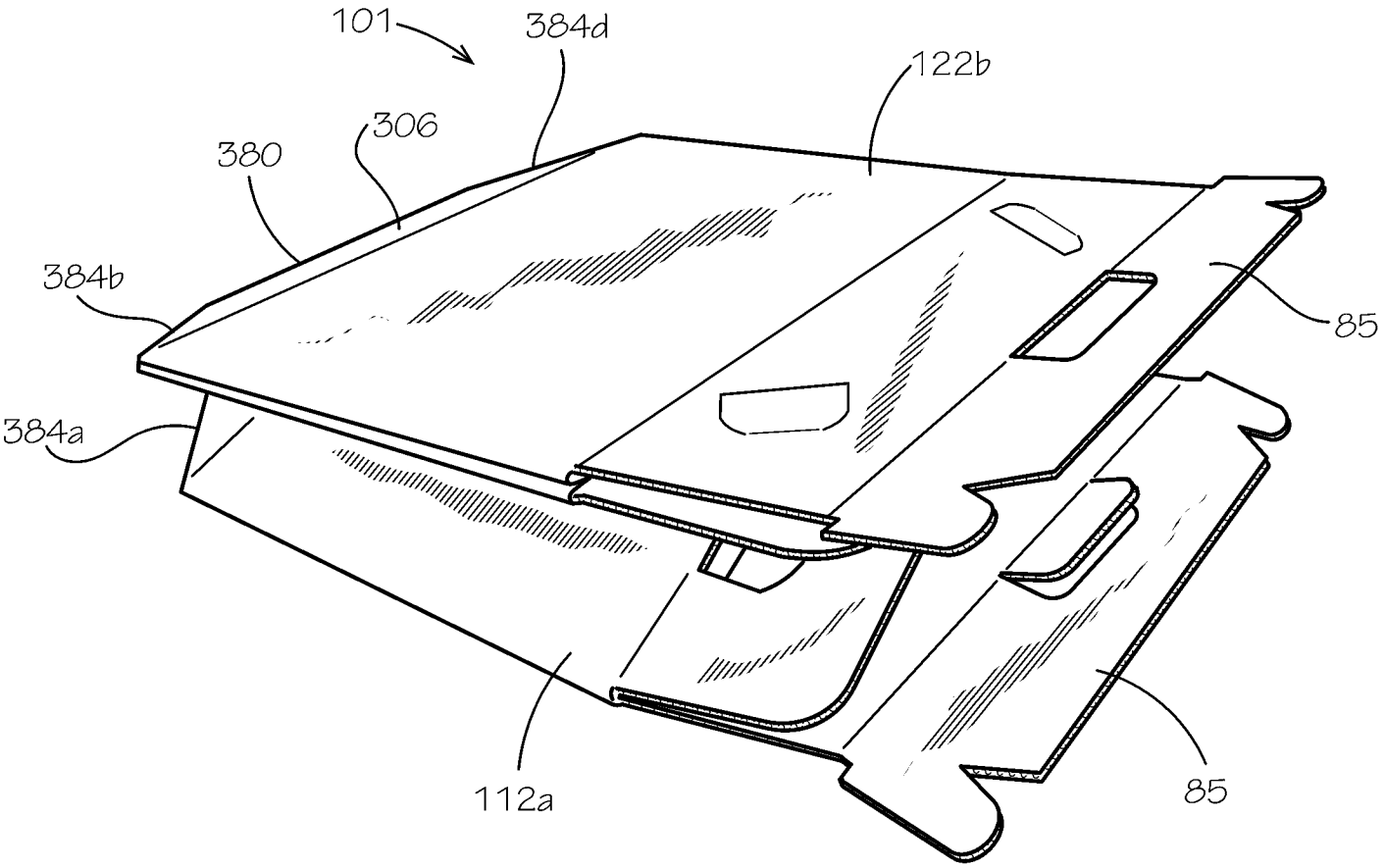
FIG. 5 is a perspective view of the box of FIG. 1 in a collapsed configuration.

FIG. 5 is a perspective view of the box 101 of FIG. 1 in a collapsed configuration. As the box 101 collapses, the side panels 122*a,b* move inwards and towards one another (122*a* shown in FIG. 3), and the side panels 112*a,b* (112*b* shown in FIG. 3) fold inwards towards one another. The V-shaped fold lines 386*a-h* (shown in FIG. 4) cooperate to transition the bottom panel 306 from a substantially planar shape to the truncated pyramidal shape. In the truncated pyramidal shape, the center subpanel 380 extends outwards and away from the side panels 112*a,b* and the side panels 122*a,b*. Exerting a force upon the center subpanel 380, such as by positioning the center subpanel on a surface and urging the side panels 112*a,b*, 122*a,b* towards the center subpanel 380 can cause the box 101 to self-expand into an expanded configuration (shown in FIG. 1) with a substantially rectangular prism shape. The self-expanding action can be desirable to allow for quick and easy reconfiguration of the box 101, unlike many boxes which must be folded and taped together. The box 101 can be shipped and stored in the collapsed configuration for space-efficient packing, and a user can simply press upon the center subpanel 380, such as by pressing the center subpanel 380 against the ground, and the box 101 can reconfigure to the expanded configuration.

Figure 6:
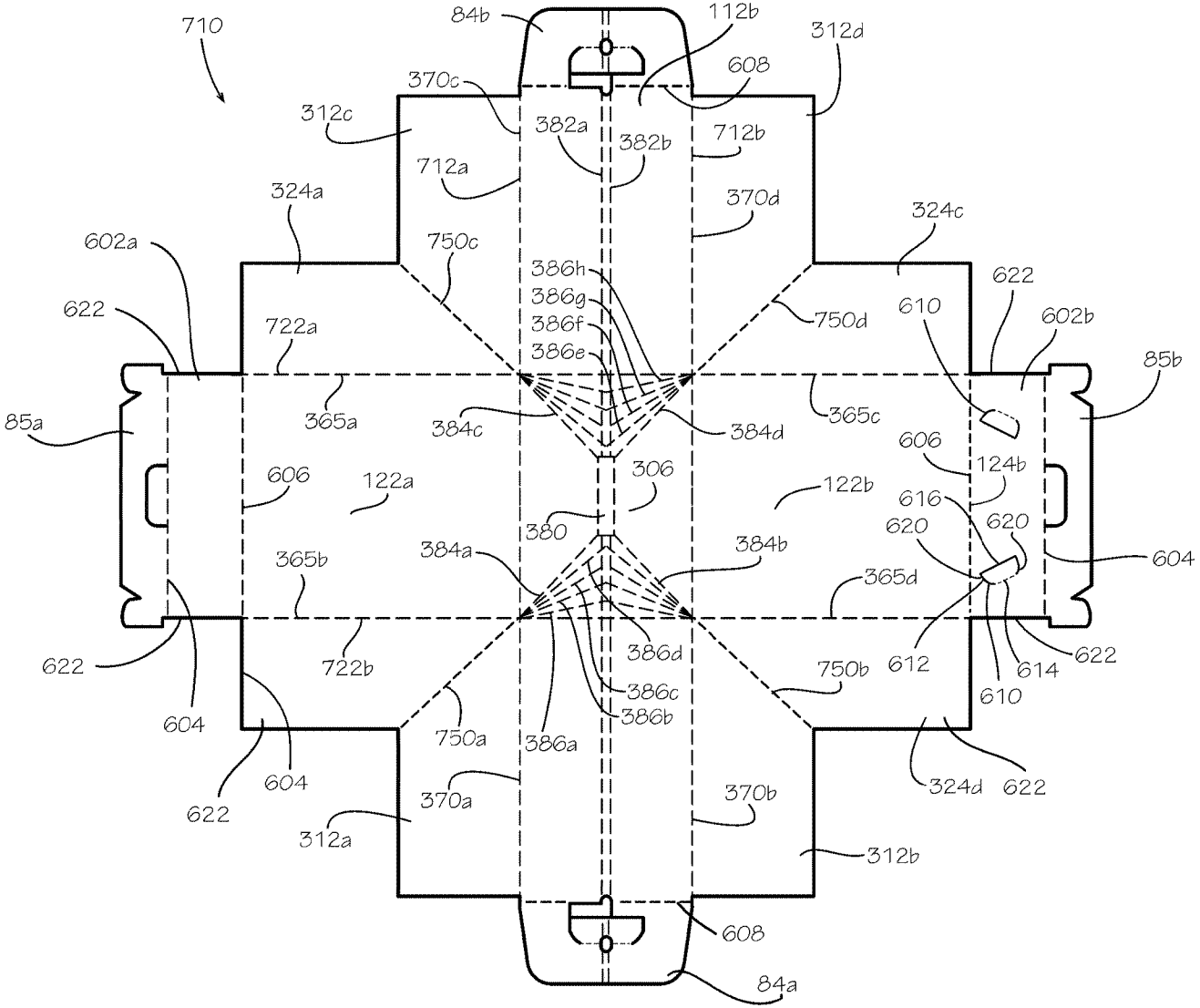
FIG. 6 is a top view of a box blank for the box of FIG. 1.

FIG. 6 is a top view of a blank 710 for the box 101 of FIG. 1. In the current aspect, the blank 710 can comprise the two handle portions 85, such as a first handle portion 85*a* and a second handle portion 85*b*. The first and the second handle portions 85*a,b* can be joined to top panels 602, such as a first and a second top panel 602*a,b*, respectively, by a fold line 604. The first and the second top panels 602*a,b* can be joined to the third and the fourth side panels 122*a,b*, respectively, by fold lines 606. The locking panels 84, such as a first and a second locking panel 84*a,b*, can be joined to the first and the second side panels 112*a,b* by a fold line 608.

The second top panel 602*b* can comprise two securing cuts 610. Each securing cut 610 can define a perimeter 612, the perimeter 612 defined by a fold line 614, a length cut 616 opposite the fold line 618, and two side cuts 620 connecting the length cut 616 and the fold line 614. Each side cut 620 can be curvilinear, such that the side cuts 620 and the fold line 614 form an approximate half circle, wherein the length cut 616 forms a diameter of the half circle. The length cut 616 can be angled with respect to a side edge 622 of the top panel 602*b*. For example, the length cut 616 and the side edge 622 can form a 45-degree angle.

In one aspect, the box blank 710 can define four corner fold lines 750*a-d*, such as a scored crease. In other aspects, the box blank 710 can define cuts in place of the corner fold lines 750*a-d*. A first corner fold line 750*a* can extend outwards from the bottom panel 306 to separate the first wing 312*a* from the second wing 324*b*. A second corner fold line 750*b* can extend outwards from the bottom panel 306 to separate the first wing 312*b* from the second wing 324*d*. A third corner fold line 750*c* can extend outwards from the bottom panel 306 to separate the first wing 312*c* from the second wing 324*a*. A fourth corner fold line 750*d* can extend outwards from the bottom panel 306 to separate the first wing 312*d* from the second wing 324*c*. In the present aspect, the adjacent first wings 312*a-d* and first wings 324*a-d* can be hingedly connected by the corner fold lines 750*a-d*. In other aspects, the corner fold lines 750*a-d* can be cuts which separate the adjacent first wings 312*a-d* and second wings 324*a-d*.

In one aspect, the box blank 710 can further define a first length fold line 712*a* and a second length fold line 712*b* extending from the side panel 112*a* to the side panel 112*b*. The first length fold line 712*a* can facilitate folding of the first wing 312*a* relative to the side panel 112*a*, the side panel 122*a* relative to the bottom panel 306, and the first wing 312*c* relative to the second side panel 112*b*. The second length fold line 712*b* can facilitate folding of the first wing 312*b* relative to the side panel 112*a*, the side panel 122*b* relative to the bottom panel 306, and the first wing 312*d* relative to the side panel 112*b*.

The box blank 710 can further define a first width fold line 722*a* and a second width fold line 722*b*. In one aspect, the width fold lines 722*a,b* can be substantially perpendicular to the length fold lines 712*a,b*. The first width fold line 722*a* can facilitate folding of the second wing 324*a* relative to the side panel 122*a*, the side panel 112*b* relative to the bottom panel 306, and the second wing 324*c* relative to the side panel 122*b*. The second width fold line 722*b* can facilitate folding of the second wing 324*b* relative to the side panel 122*a*, the side panel 112*a* relative to the bottom panel 306, and the second wing 324*d* relative to the side panel 122*b*.

The center fold line 382 can extend across and substantially bisect each side panel 112*a,b*. In one aspect, the center fold line can facilitate each of the side panels 112*a,b* folding inwards about the center fold line 382 and towards the bottom panel 306 to facilitate collapsing the box 101 as shown in FIG. 5. If the center fold line comprise a double center fold line 382*a,b*, as illustrated in FIG. 6, the center fold lines can facilitate each of the side panels 112*a,b* more easily folding inwards about the first center fold line 382*a* and the second center fold line 382*b* and towards the bottom panel 306 to facilitate collapsing the box 101.

Figure 7:
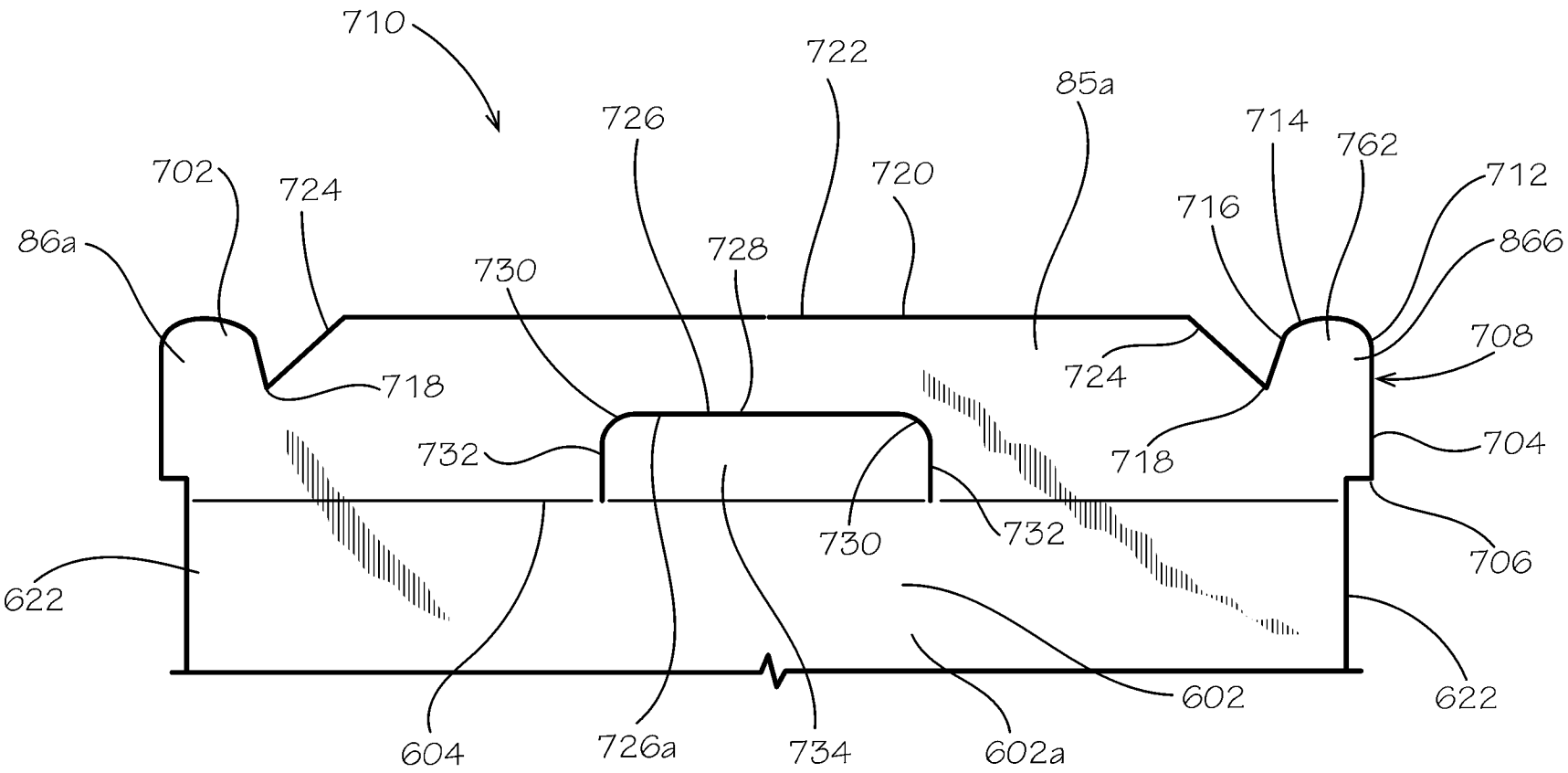
FIG. 7 is a view of a first handle portion of the box blank of FIG. 6.

FIG. 7 is a view of the first handle portion 85*a* of the box blank 710. Each handle portion 85 can comprise a side end 86, such as a first side end 86*a* and a second side end 86*b*. Each side end 86 can comprise a tab 702, the tab 702 defining a perimeter edge 704. The perimeter edge 704 of the tab 702 can comprise a corner 706 extending laterally past the side edge 622 of the adjoining top panel 602. From the corner 706, the perimeter edge 704 can comprise a straight lateral edge 708 that extends away from the top panel 602 in a direction parallel to the side edge 622 of the top panel 602. From the lateral edge 708, the tab perimeter edge 704 can continue along a curvilinear corner 712 and a top edge 714. The perimeter edge 704 can continue from the tab top edge 714 to an inner side edge 716 of the tab 702. The inner side edge 716 can end in a notch 718 between the inner side edge 716 and a middle portion 720 of the handle portion 85. The middle portion 720 can comprise a top edge 722 and a sloped edge 724 between the top edge 722 and the tab 702, the sloped edge 724 meeting the tab 702 at the notch 718.

The handle portion 85*a* can define a handle cut 726 adjacent to the fold line 604. The handle cut 726 can comprise a top edge 728, two curvilinear top corners 730, and two side edges 732. In some aspects, the handle cut 726 can lack a bottom edge, such as on a first handle cut 726*a* on the first handle portion 85*a* of FIG. 7. When the blank 710 (shown in FIG. 6) is assembled into the box 101 (shown in FIG. 1), the first handle portion 85*a* can fold approximately perpendicular to the first top panel 602*a*. As such, a handle hole flap 734, defined on its outside edge by the handle cut 726, can fold and remain coplanar with the top panel 602, such that the flap 734 is also perpendicular to the handle portion 85, and the configuration can reveal a handle hole 804 (shown in FIG. 8).

Figure 8:
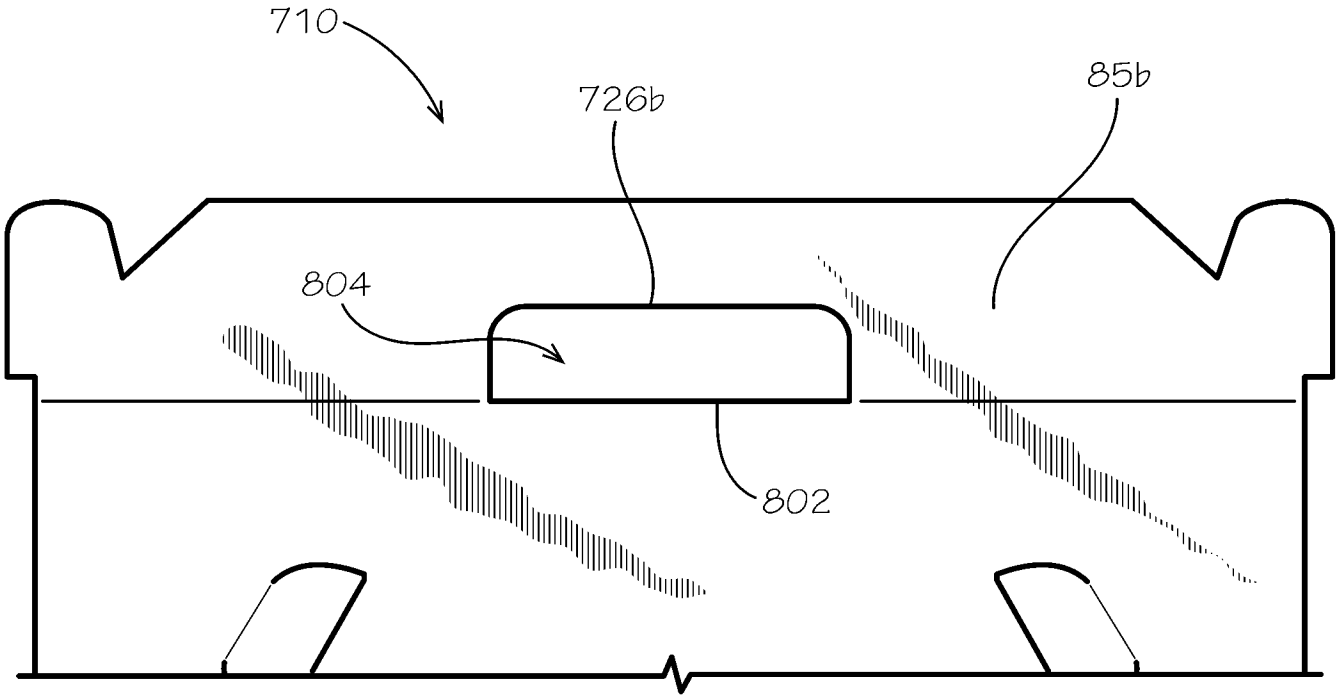
FIG. 8 is a view of a second handle portion of the box blank of FIG. 6.

FIG. 8 is a view of the second handle portion 85*b* of the box blank 710. The second handle portion 85*b* can define a second handle cut 726*b*, the second handle cut 726*b* further comprising a bottom edge 802 that is a bottom cut, such that the handle hole 804 is exposed even in a flat configuration.

Figure 9:
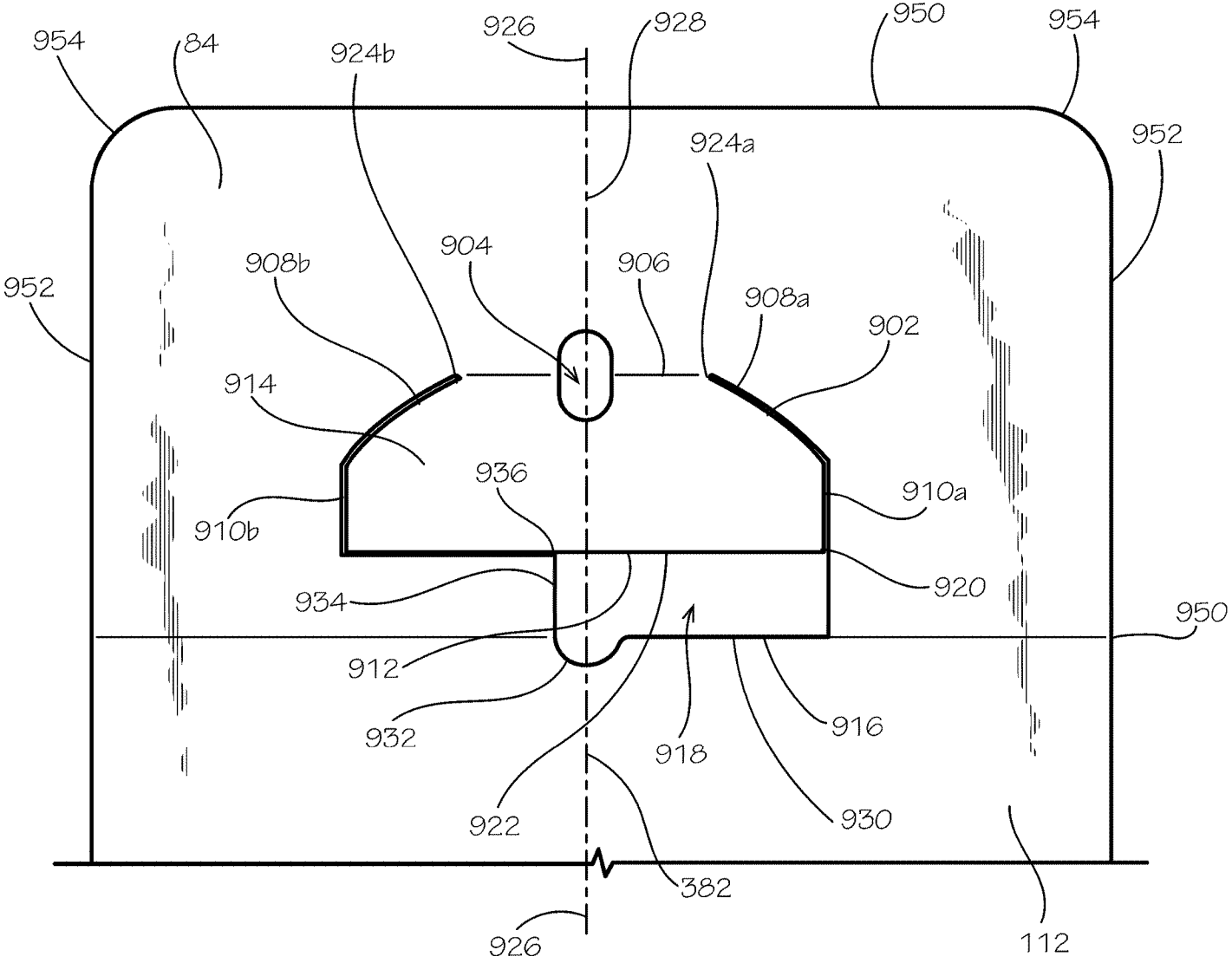
FIG. 9 is view facing a locking panel of the box of FIG. 1.

FIG. 9 shows one of the locking panels 84. The locking panel 84 can comprise a top edge 950 and two side edges 952, the top edge 950 and the side edges 952 meeting at two curvilinear top corners 954. The locking panel 84 can define a handle-engaging cut pattern 902. The parts of the cut pattern 902 are first described and labeled in FIG. 9. The cut pattern 902 can define a top hole 904. The top hole 904 can be an oval, for example and without limitation. A fold line 906 can horizontally bisect the top hole 904. Following the cut pattern 902 clockwise, as oriented in FIG. 9, the fold line 906 can meet a first corner cut 908*a* which slopes down until it meets a first side cut 910*a* (on the right side of FIG. 9). The first corner cut 908*a* can slope toward a bottom corner 950 of the locking panel 84, the bottom corner 950 located at an intersection of the locking panel 84, the attached side panel 112, and one of the side panels of the second pair of side panels 122 (not shown) when in the assembled configuration.

Approximately halfway down the first side cut 910*a*, the cut pattern 902 can separate into an inner cut 912 bordering an inner flap 914 and an outer cut 916 outlining a space 918 through which the handle tab 702 (not shown) can be received. Continuing clockwise from a point 920 where the inner cut 912 and the outer cut 916 separate, the inner cut 912 extends horizontally (to the left) along an inner flap bottom cut 922 toward a second side cut 910*b*. The second side cut 910*b* can meet a second corner cut 908*b*, the second corner cut 908*b* meeting the fold line 906 at a second meeting point 924*b* opposite a first meeting point 924*a* where the fold line 906 meets the first corner cut 908*a*. The inner flap 914 can have reflection symmetry about vertical line 926-926. A segment 928 of the center fold line 382 along line 926-926 can extend from the side panels 112 to the locking panel 84.

Continuing along the outer cut 916 in a clockwise direction (still with respect to FIG. 9) from the point 920, the first side cut 910*a* continues down until it meets a first bottom cut 930 that extends horizontally until meeting a bottom notch 932 along line 926-926. The bottom notch 932 can be a half circle. The bottom notch 932 can adjoin a vertical edge 934 that extends up to meet the inner flap 914 proximate to the line 926-926. At a point 936 where the vertical edge 934 meets the inner flap 914, the outer cut 916 can join the inner cut 912, such that continuing clockwise around the cut pattern 902, both the inner cut 912 and the outer cut 916 follow the flap bottom cut 922 to meet the second side cut 910*b*. The cut pattern 902 on one of the locking panels 84 can be a mirror image of the cut pattern 902 on the opposing locking panel 84.

Figure 10:
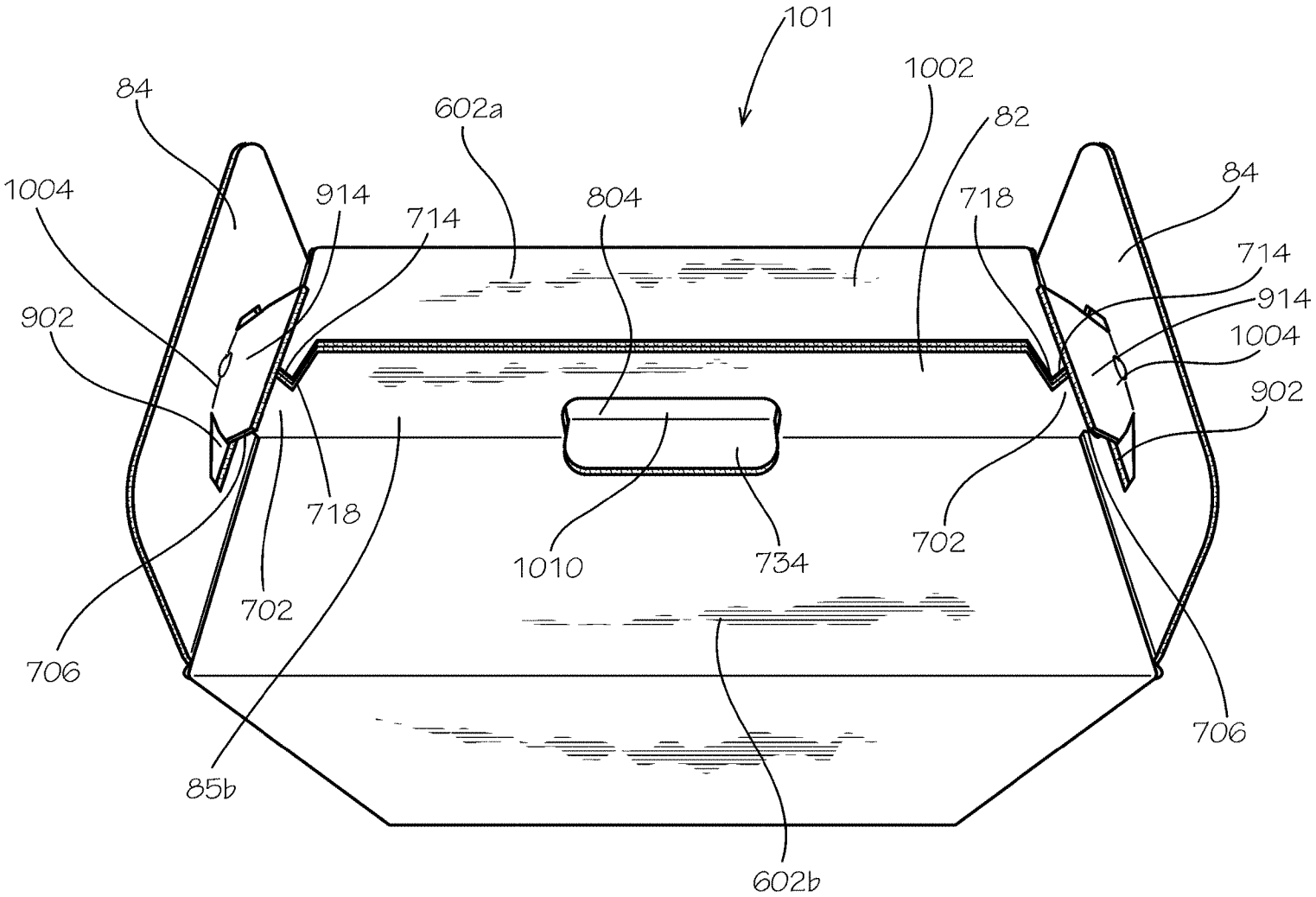
FIG. 10 is a perspective view of the box of FIG. 1, wherein the handle assembly of FIG. 3 is partially-assembled.

FIG. 10 is a perspective view of the box 101, wherein the handle assembly 82 is partially-assembled. In the current aspect, the first and the second top panels 602*a,b* can fold down to form a top surface 1002 of the box 101. The handle hole flap 734 of the first handle portion 85*a* (hidden behind second handle portion 85*b*) can pass through the handle hole 804 of the second handle portion 85*b*. The handle hole flap 734 can press against the second top panel 602*b* to provide stability to the top surface 1002. The bottom notch 932 (shown in FIG. 9) of the cut pattern 902 can receive the tab corners 706 of the handle portions 85*a,b*, preventing the top surface 1002 from depressing further into the box 101.

The inner flaps 914 of the locking panels 84 can fold up and inward toward a center 1010 of the box 101. As such, the top hole 904 (shown in FIG. 9) can fold in half, onto itself, revealing a top notch 1006 (shown in FIG. 12). The fold line 906 (shown in FIG. 9) bisecting the top hole 904 can be a top edge 1004 in this configuration. The locking panels 84 can fold towards the center 1010, such that the top notch 1006 (shown in FIG. 11) of each locking panel 84 can slide over the top edge 714 of the handle tab 702 and receive the handle notch 718.

Figure 11:
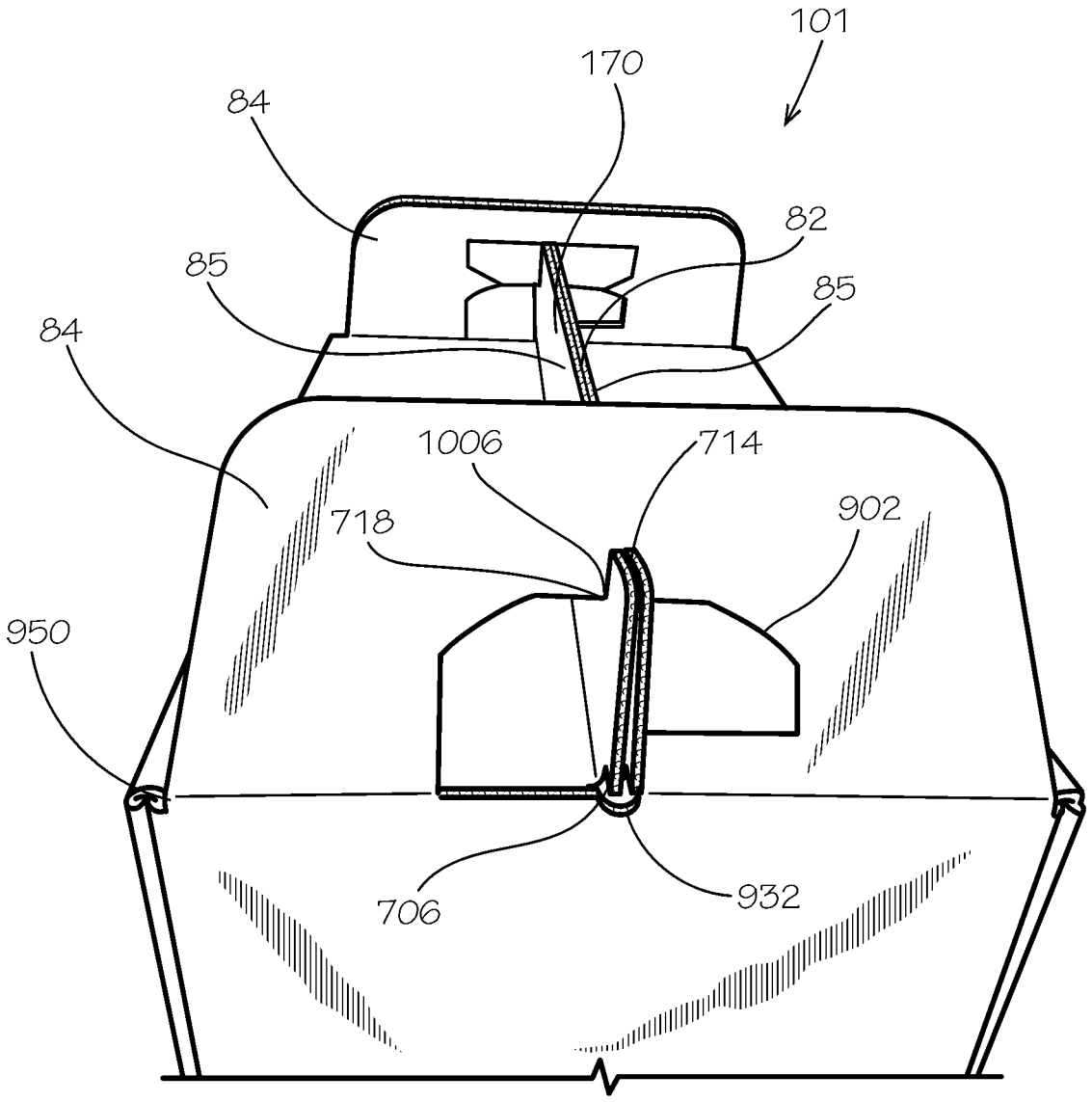
FIG. 11 is a perspective view of one end of the handle assembly of FIG. 3, wherein the handle of FIG. 1 is in an upright position.

FIG. 11 is a perspective view of one side of the handle assembly 82 in an assembled configuration, wherein the handle 170 is in an upright position. The top notch 1006 of the cut pattern 902 can meet or contact the handle notch 718. As such, the box 101 can be picked up by the handle 170, the locking panels 84 preventing the handle portions 85 from separating.

Figure 12:
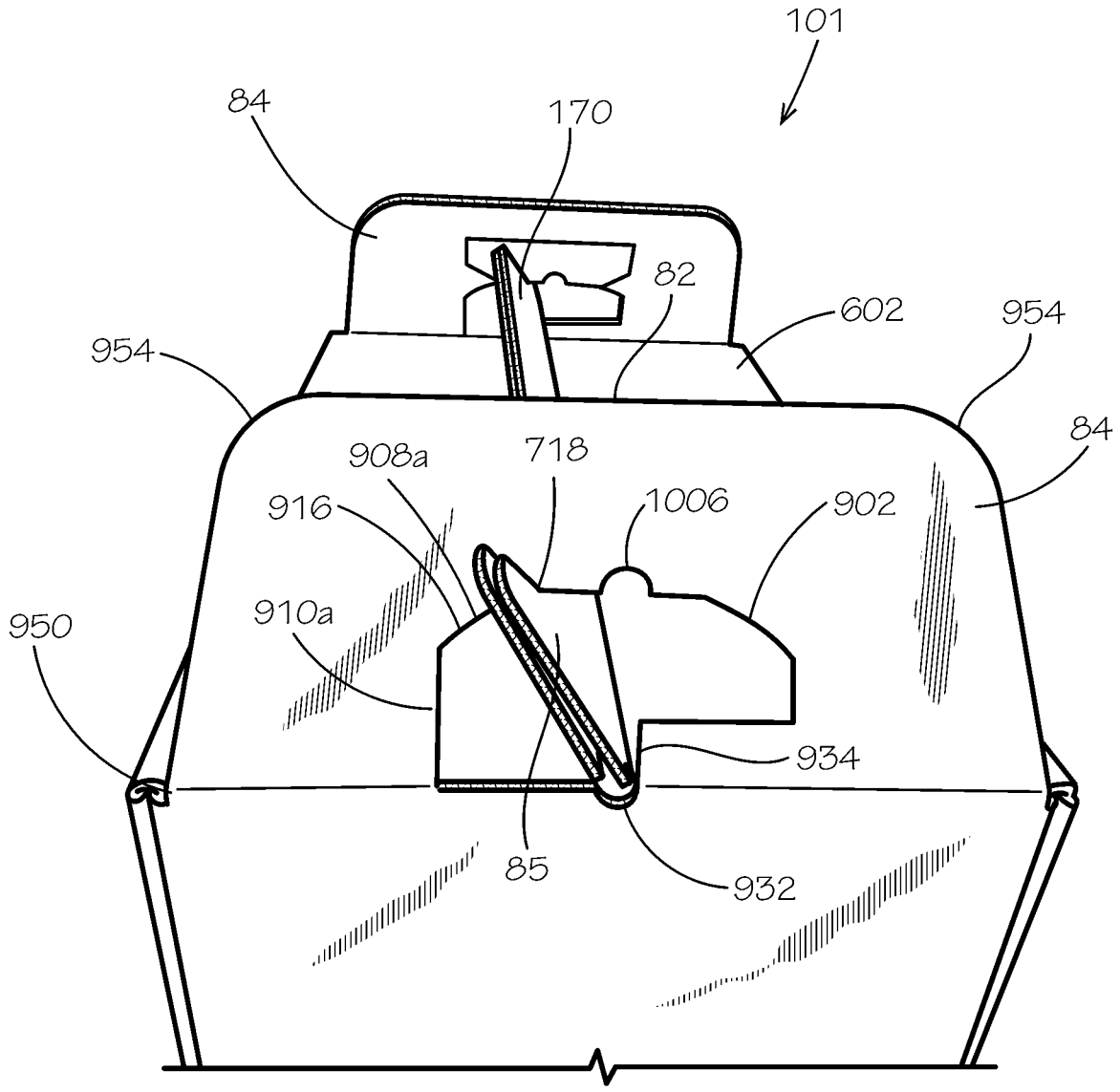
FIG. 12 is a perspective view of the handle assembly of FIG. 3, wherein the handle of FIG. 1 is partially folded down.

FIG. 12 is a perspective view of the handle assembly 82 of the box 101, wherein the handle 170 is partially folded down. The vertical edge 934 of the bottom notch 932 can prevent the handle 170 from folding down in one direction (such as to the right, as shown in FIG. 12). The handle 170 can fold down in a direction opposite the vertical edge 934. As the handle 170 folds down, the handle notch 718 can engage the outer cut 916 of the cut pattern 902, such that the locking panels 84 are pulled down to the top surface 1002 (shown in FIG. 10) of the box 101 with the handle 170. In the folded-down configuration, the notches 718 of the handle portion 85 can touch or be proximate to a point where the first corner cut 908*a* meets the first side cut 910*a*. One of the top corners 954 of each locking panel 84 can be inserted into one of the securing cuts 610 (shown in FIG. 2) of the top panel 602, as shown in FIG. 2. As such, the locking panels 84 can hold down the handle 170 in the folded-down configuration. In this configuration, a plurality of the boxes 101 can be stacked compactly—for example, in a retail display area. When a customer wishes to purchase one of the boxes 101, they can easily pop the locking panels 84 out of the securing cuts 610, raise the handle 170 to the upright configuration, and carry box 101 by the handle 170 with one hand.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A box comprising:

a first side panel;

a second side panel positioned perpendicular to the first side panel;

a top panel joined to the first side panel; and a handle assembly, the handle assembly comprising:

a handle portion attached the top panel, the handle portion comprising a tab at a side end of the handle portion, and a locking panel attached to the second side panel, the locking panel defining a cut pattern, the cut pattern defining a space therewithin, the cut pattern defining a top edge and an inner flap, the top edge of the cut pattern being a fold line formed by folding the inner flap up above the top edge; and wherein the tab is received by the space.

2. The box of claim 1, wherein a top hole intersects the fold line, and wherein the top hole forms a top notch when the inner flap is folded up above the top edge.

3. The box of claim 2, wherein the handle portion defines a handle notch adjacent to the tab, and wherein the handle notch engages the top notch.

4. The box of claim 2, wherein the cut pattern defines a bottom notch below the top notch.

5. The box of claim 1, wherein the cut pattern defines a vertical edge configured to limit rotation of the handle portion relative to the locking panel when the tab is inserted into the space.

6. The box of claim 1, wherein the handle portion defines a handle notch adjacent to the tab, and wherein the handle notch engages the inner flap when the inner flap is folded above the top edge and the tab is inserted into the space.

7. The box of claim 1, wherein the top panel defines a securing cut configured to receive a corner of the locking panel.

8. The box of claim 1, wherein the handle portion is configured to fold from an upright configuration to a folded-down configuration.

9. The box of claim 8, wherein the handle portion defines a handle notch adjacent to the tab, and wherein the handle portion is configured to fold from the upright configuration to the folded-down configuration by sliding a handle notch along a sloping corner cut of the cut pattern to draw the locking panel toward the top panel.

10. The box of claim 9, wherein the sloping corner cut intersects the top edge.

11. A method of assembling a box, comprising:

obtaining a box blank, the box blank comprising:

a first side panel and a second side panel;

a top panel joined to the first side panel;

a handle portion attached to the top panel, the handle portion comprising a tab at a side end of the handle portion;

a locking panel attached to the second side panel, the locking panel defining a cut pattern, the cut pattern defining a space therewithin;

folding an inner flap defined by the cut pattern up above a fold line to form a top edge of the cut pattern; and inserting the tab of the handle portion into the space of the cut pattern of the locking panel.

12. The method of claim 11, further comprising engaging a handle notch of the handle portion with a top notch, the handle notch defined by the handle portion adjacent to the tab, the top notch intersecting the top edge.

13. The method of claim 11, wherein folding the inner flap defined by the cut pattern up above the fold line to form a top edge of the cut pattern comprises folding a top hole to define a top notch in the top edge, the top hole intersecting the fold line.

14. The method of claim 11, further comprising drawing the locking panel toward the top panel by sliding a handle notch along a sloping corner cut of the cut pattern, the handle notch defined by the handle portion adjacent to the tab, the sloping corner cut intersecting the top edge.

15. The method of claim 11, further comprising inserting a top corner of the locking panel into a securing cut of the top panel.

16. The method of claim 11, further comprising folding the handle portion from an upright configuration to a folded-down configuration.

17. The method of claim 16, wherein the handle portion contacts a vertical edge of the cut pattern in the upright configuration.

18. A blank for a box comprising:

a first side panel and a second side panel;

a top panel joined to the first side panel;

a handle portion attached to the top panel, the handle portion comprising a tab at a side end of the handle portion; and a locking panel attached to the second side panel, the locking panel defining a cut pattern, the cut pattern defining:

a space therewithin; and a top edge defined by a top fold line, the top fold line coupling a foldable flap to the locking panel, the foldable flap positioned within the space when the foldable flap is in an unfolded configuration, the foldable flap configured to fold upwards from the unfolded configuration to a folded configuration wherein the foldable flap is positioned above the top edge.

19. The blank of claim 18, wherein a top hole intersects the top fold line, and wherein the top hole forms a top notch when the foldable flap is in the folded configuration.

20. The blank of claim 19, wherein the cut pattern further defines a bottom notch positioned below the top notch.

* * * * *